US006479951B2

(12) United States Patent
Takekawa et al.

(10) Patent No.: US 6,479,951 B2
(45) Date of Patent: Nov. 12, 2002

(54) COLOR CATHODE RAY TUBE APPARATUS

(75) Inventors: Tustomu Takekawa, Fukaya (JP); Hirofumi Ueno, Fukaya (JP); Noriyuki Miyamoto, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/024,317

(22) Filed: Dec. 21, 2001

(65) Prior Publication Data

US 2002/0053887 A1 May 9, 2002

Related U.S. Application Data

(63) Continuation of application No. PCT/JP01/03531, filed on Apr. 24, 2001.

(30) Foreign Application Priority Data

Apr. 25, 2000 (JP) ..... 2000-124489

(51) Int. Cl.[7] ..... H01J 29/58
(52) U.S. Cl. ..... 315/382
(58) Field of Search ..... 315/1, 5.26, 5.34, 315/8, 15, 16, 364, 368.11, 368.15, 370, 382; 313/412–414, 428, 447–449

(56) References Cited

U.S. PATENT DOCUMENTS 5,063,326 A * 11/1991 Cho ..... 313/414
5,164,640 A * 11/1992 Son et al. ..... 313/414
5,517,078 A * 5/1996 Sugawara et al. ..... 313/412
5,936,338 A * 8/1999 Takahashi ..... 313/412

FOREIGN PATENT DOCUMENTS

| | | |
|---|---|---|
| JP | 3-101036 A | 4/1991 |
| JP | 6-36706 A | 2/1994 |
| JP | 9-73867 | 3/1997 |
| JP | 10-162752 A | 6/1998 |
| JP | 11-120934 | 4/1999 |
| JP | 2000-285823 A | 10/2000 |

* cited by examiner

*Primary Examiner*—Haissa Philogene
(74) *Attorney, Agent, or Firm*—Oblon, Spivak, McClelland, Maier & Neustadt, P.C.

(57) ABSTRACT

A color cathode ray tube apparatus of this invention includes an electron gun. In the electron gun, an intermediate electrode is arranged at the mechanical center between a focus electrode and anode electrode that form a rotationally symmetric bi-potential lens. A disk-like intermediate electrode is arranged at the mechanical center between the focus electrode and intermediate electrode. The disk-like intermediate electrode has an electron beam hole with a diameter larger in the vertical direction than in the horizontal direction. The intermediate electrode has a circular electron beam hole. Voltages are applied to the disk-like intermediate electrode and intermediate electrode such that they form an electron lens similar to that formed when the disk-like intermediate electrode does not exist. Therefore, an electron beam spot is focused in an optimal manner on the entire surface of a phosphor screen, and elliptic distortion is decreased. A good image is displayed on the entire surface of the phosphor screen.

3 Claims, 11 Drawing Sheets

First quadrant of phosphor screen

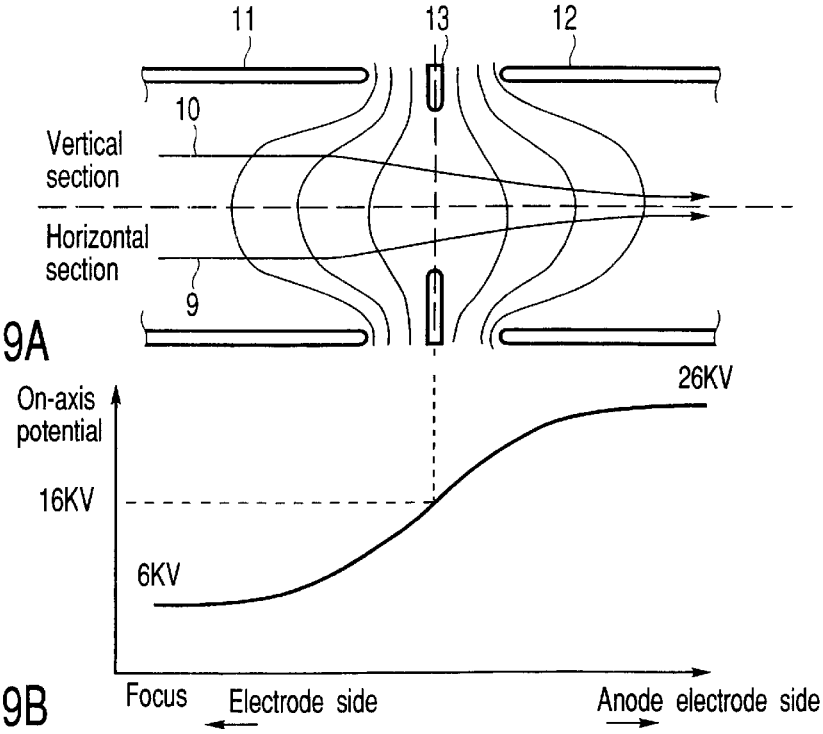
FIG. 9A
FIG. 9B
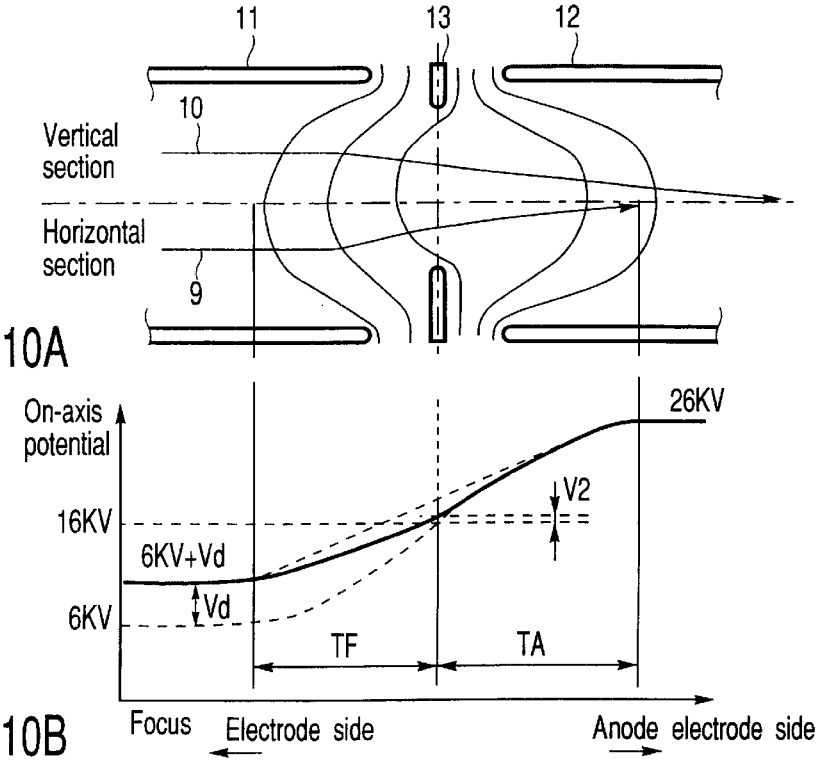
FIG. 10A
FIG. 10B

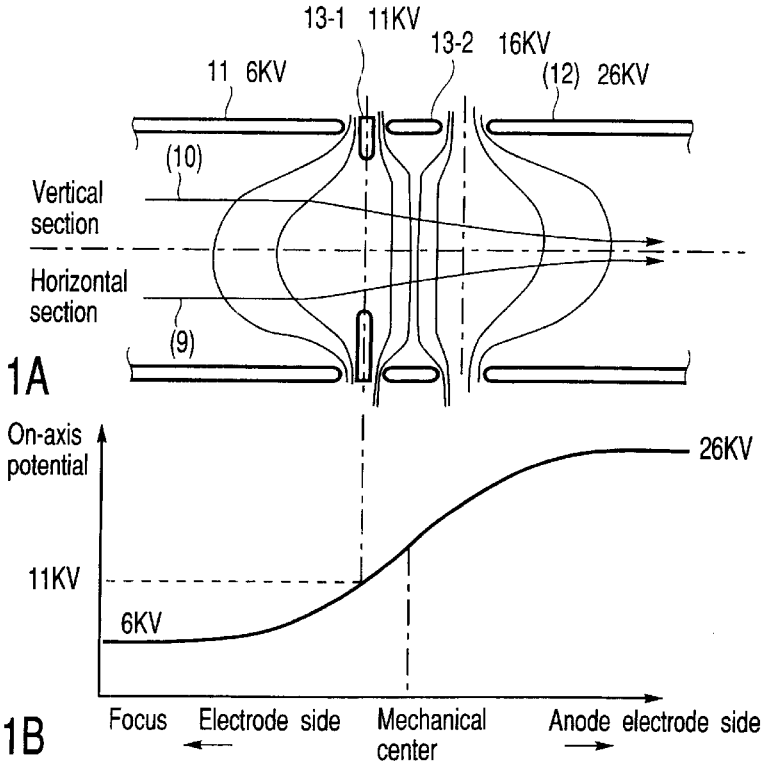
FIG. 11A
FIG. 11B
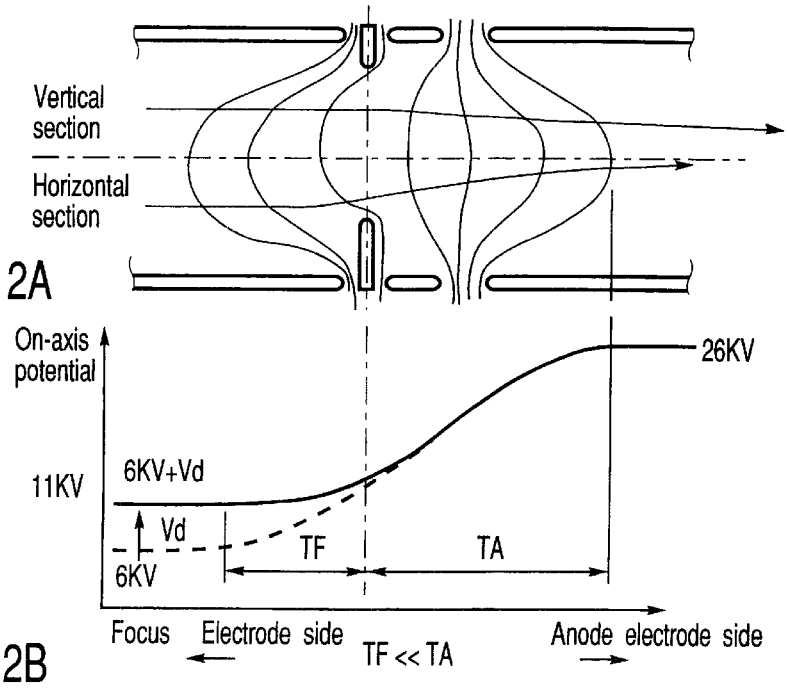
FIG. 12A
FIG. 12B

COLOR CATHODE RAY TUBE APPARATUS

CROSS REFERENCE TO RELATED APPLICATIONS

This is a Continuation Application of PCT Application No. PCT/JP01/03531, filed Apr. 24, 2001, which was not published under PCT Article 21(2) in English.

This application is based upon and claims the benefit of priority from the prior Japanese Patent Application No. 2000–124489, filed Apr. 25, 2000, the entire contents of which are incorporated herein by reference.

BACKGROUND OF THE INVENTION

1. Field of the Invention

The present invention relates to a color cathode ray tube and, more particularly, to a color cathode ray tube apparatus in which the elliptic distortion of electron beam spot shapes on the periphery of a phosphor screen is improved to allow displaying an image with a good image quality.

2. Description of the Related Art

Generally, as shown in FIG. 1, in a color cathode ray tube, a panel 1 is integrally bonded to a funnel 2. A phosphor screen 4 comprised of three color phosphor layers for emitting red, green, and blue light is formed on the inner surface of the faceplate of the panel 1. A shadow mask 3 having a large number of electron beam holes is mounted inside the panel 1 to oppose the phosphor screen 4. An electron gun 6 is arranged in a neck 5 of the funnel 2. Three electron beams 7B, 7G, and 7R emitted from the electron gun 6 are deflected by a magnetic field generated by a deflecting yoke 8 mounted on the outer surface of the funnel 2 and are directed toward the phosphor screen 4. The phosphor screen 4 is scanned horizontally and vertically by the deflected electron beams 7B, 7G, and 7R, thereby displaying a color image on the phosphor screen 4.

As a color cathode ray tube of this type, an in-line type color cathode ray tube is available. In the in-line type color cathode ray tube, the electron gun 6 is of an in-line type that emits three in-line electron beams made up of a center beam and a pair of side beams traveling on one horizontal plane. The deflecting yoke 8 generates a nonuniform magnetic field such that the horizontal deflecting magnetic field forms a pincushion type field and the vertical deflecting magnetic field forms a barrel type field. Thus, the three electron beams self-converge.

For the in-line type electron gun for emitting three in-line electron beams, various types and methods are available. A typical example is a so-called BPF (Bi-Potential Focus) dynamic focus (Dynamic Astigmatism Correction and Focus) type electron gun. This BPF dynamic distortion-compensating focus type electron gun is comprised of first to fourth grids G1 to G4. The grids G1 to G4 are integrated with each other and sequentially arranged from three in-line cathodes K toward a phosphor screen 4, as shown in FIG. 2. Each of the grids G1 to G4 has three electron beam holes corresponding to the three in-line cathodes K. In this electron gun, a voltage of about 150 V is applied to the cathodes K. The first grid G1 is grounded. A voltage of about 600 V is applied to the second grid G2. A voltage of about 6 kV is applied to the (3–1)st and (3–2)nd grids G3–1 and G3–2. A high voltage of about 26 kV is applied to the fourth grid G4.

In the above electrode structure to which the above voltages are applied, the cathodes K and the first and second grids G1 and G2 make up a triode for generating electron beams and forming an object point with respect to a main lens (to be described later). A prefocus lens is formed between the second and (3–1)st grids G2 and G3–1 to prefocus the electron beams emitted from the triode. The (3–2)nd and fourth grids G3–2 and G4 form a BPF (Bi-Potential Focus) main lens for finally focusing the prefocused electron beams onto the phosphor screen. If the deflecting yoke 8 deflects the electron beams to the periphery of the phosphor screen, a preset voltage is applied to the (3–2)nd grid G3–2 in accordance with the deflecting distance. This voltage is the lowest when the electron beams are directed toward the center of the phosphor screen and the highest when the electron beams are directed toward the corners of the phosphor screen, thus forming a parabolic waveshape. As the above electron beams are deflected to the corners of the phosphor screen, the potential difference between the (3–2)nd and fourth grids G3–2 and G4 decreases, and the intensity of the main lens described above is decreased. The intensity of the main lens is minimum when the electron beams are directed toward the corners of the phosphor screen. As the intensity at the main lens changes, the (3–1)st and (3–2)nd grids G3–1 and G3–2 form a tetrode lens. The tetrode lens is the most intense when the electron beams are directed toward the corners of the phosphor screen. The tetrode lens has a focusing function in the horizontal direction and a divergent function in the vertical direction. Thus, as the distance between the electron gun and phosphor screen increases and the image point becomes far, the intensity at the main lens decreases accordingly. As a result, a focus error based on a change in distance is compensated for. Deflection astigmatism caused by the pincushion type horizontal deflecting field and barrel type vertical deflecting field of the deflecting yoke is compensated for by the tetrode lens.

To improve the image quality of the color cathode ray tube, the focus characteristics on the phosphor screen must be improved. In particular, in a color cathode ray tube in which an electron gun for emitting three in-line electron beams is sealed, the elliptic distortion and blurring, as shown in FIG. 3A, of an electron beam spot which are caused by deflection astigmatism become an issue. In a defection astigmatism compensating method generally called the BPF dynamic distortion-compensating focus method, a low-voltage side electrode which forms the main lens is divided into a plurality of elements such as the (3–1)st and (3–2)nd grids G3–1 and G3–2. A tetrode lens is formed in accordance with the deflection of the electron beams. This method can solve the problem of blurring as shown in FIG. 3B. As shown in FIG. 3B, however, a phenomenon still occurs in which electron beam spots are laterally flattened at the ends of the horizontal axis and the ends of the orthogonal axis of the phosphor screen. This causes moire due to interference with the shadow mask 3. If electron beam spots form a character or the like, the character cannot be recognized easily.

The phenomenon in which an electron beam spot is laterally flattened will be described with reference to optical models shown in FIGS. 4A, 4B, and 4C.

FIG. 4A shows an optical system formed when the electron beams reach the center of the phosphor screen without being deflected, and the loci of the electron beams. FIG. 4B shows an optical system formed when the electron beams reach the periphery of the screen after being deflected by the deflecting magnetic fields, and the loci of the electron beams. The size of the electron beam spot on the phosphor screen depends on a magnification (M), and the magnification of the electron beam in the horizontal direction is defined as Mh and that in the vertical direction is defined as Mv. The magnification M can be expressed as (divergent angle αo/incident angle αi) shown in FIGS. 4A and 4B. More specifically, $Mh$(horizontal magnification)=$\alpha oh$(horizontal divergent angle)/$\alpha ih$(horizontal incident angle)

$Mv$(vertical magnification)=$\alpha ov$(vertical divergent angle)/$\alpha iv$(vertical incident angle)

Assume that the horizontal divergent angle αoh and vertical divergent angle αov are equal (αoh=αov). In the non-deflection mode shown in FIG. 4A, the horizontal incident angle αih and vertical incident angle αiv become equal (αih=αiv) and the horizontal magnification Mh and vertical magnification Mv become equal (Mh=Mv). In the deflection mode shown in FIG. 4B, the horizontal divergent angle αoh becomes smaller than the vertical divergent angle αov (αih<αiv), and the vertical magnification Mv becomes smaller than the horizontal magnification Mh (Mv<Mh). In other words, the electron beam spot becomes circular at the center of the phosphor screen but is laterally elongated on the periphery of the phosphor screen.

As a method of moderating the phenomenon in which the electron beam spot becomes laterally elongated on the periphery of the phosphor screen, a tetrode lens is formed in the main lens. This method will be described with reference to the optical model shown in FIG. 4C.

In this optical lens, in the same manner as in the models shown in FIGS. 4A and 4B, $M_h'$(horizontal magnification)=$\alpha_{oh}'$(horizontal divergent angle)/$\alpha_{ih}'$(horizontal incident angle)

$M_v'$(vertical magnification)=$\alpha_{ov}'$(vertical divergent angle)/$\alpha_{iv}'$(vertical incident angle)

As is apparent from comparison of FIGS. 4B and 4C, when the tetrode lens becomes closer to the tetrode formed by the deflecting magnetic field, $\alpha_{oh}$(horizontal divergent angle)=$\alpha_{oh}'$(horizontal divergent angle)

$\alpha_{ov}$(vertical divergent angle)=$\alpha_{ov}'$(vertical divergent angle)

$\alpha_{ih}$(horizontal incident angle)<$\alpha_{ih}'$(horizontal incident angle)

$\alpha_{iv}$(vertical incident angle)>$\alpha_{iv}'$(vertical incident angle)

In other words,

Mh'<Mh

Mv'>Mv are obtained, and the elliptic ratio of the electron beam spot on the periphery of the screen is moderated as shown in FIG. 5.

More specifically, the tetrode lens is formed in the main lens in the following manner. A disk-like intermediate lens is set between the focus electrode and anode electrode. A voltage which is the intermediate between voltages applied to the focus electrode and anode electrode is applied to the disk-like intermediate electrode. Vertically elongated electron holes are formed in the disk-like electrode, as shown in FIG. 6. A parabolic voltage as shown in FIG. 16A to be referred to again later, which increases as the deflecting amount of the electron beam increases in synchronism with a change in magnetic field, is applied to the focus electrode. When the voltage of the focus electrode increases, the potential difference between the focus electrode and intermediate electrode decreases. Potential penetration occurs through the electron beam holes of the intermediate electrode. A difference in focusing power is produced between the horizontal and vertical directions of the electron beam. Hence, a tetrode lens operation occurs in the main lens.

With the electrode structure employing the electrode shown in FIG. 6, in practice, in the tetrode lens formed by causing potential penetration in the electron beam holes of the intermediate electrode, the tetrode lens operation is small. More specifically, the tetrode lens operation, which is necessary when the electron beam is deflected toward the periphery of the phosphor screen, becomes insufficient. As shown in FIG. 7, the electron beam deflected toward the periphery of the phosphor screen is not sufficiently focused in the horizontal direction and excessively focused in the vertical direction. Thus, a good image cannot be obtained.

As described above, in order to improve the image quality of the color cathode ray tube, a good focusing state must be maintained on the entire surface of the phosphor screen, and the elliptic distortion of the electron beam spot must be decreased. In the conventional BPF type dynamic focus electron gun, an appropriate parabolic voltage is applied to the low voltage side of the main lens. This changes the lens intensity (lens power) of the main lens, and simultaneously forms a tetrode lens that changes dynamically. Then, the blur of the electron beam in the vertical direction, which is caused by the deflection aberration, can be eliminated. As a result, focusing can be performed on the entire surface of the phosphor screen. On the periphery of the phosphor screen, however, the lateral flattening of the electron beam spot is apparent. This phenomenon occurs due to the following reason. When the electron beam scans the periphery of the phosphor screen, the horizontal magnification Mh and vertical magnification Mv maintain a relationship Mv>Mh due to the electron lens formed by the electron lens and the astigmatism of the deflecting magnetic field.

As a countermeasure for this, formation of a tetrode lens in the main lens is effective. A plate-like intermediate lens is arranged between the focus electrode and anode electrode. An intermediate voltage between the voltages applied to the focus electrode and anode electrode is applied to the intermediate electrode. Vertically elongated electron beam holes are formed in the intermediate electrode. An appropriate parabolic voltage is applied to the focus electrode. Thus, a tetrode lens can be formed in the main lens.

With this method, however, the effect of the tetrode lens cannot be sufficiently obtained. On the periphery of the phosphor screen, the electron beam spot is insufficiently focused in the horizontal direction and is excessively focused in the vertical direction. Hence, a good image quality cannot be obtained.

BRIEF SUMMARY OF THE INVENTION

It is an object of the present invention to provide a color cathode ray tube apparatus with a good performance on the entire surface of a phosphor screen, in which the electron beam spot is focused in the optimal manner on the entire surface of the phosphor screen and elliptic distortion is decreased.

According to the present invention, there is provided a color cathode ray tube apparatus comprising:

an electron gun in which a main lens for accelerating and focusing an electron beam toward a screen is formed; and a deflecting yoke which deflects the electron beam emitted from the electron gun and scans the screen with the deflected electron beam in horizontal and vertical directions, wherein the main lens is formed of a focus electrode, a plurality of intermediate electrodes, and an anode electrode each of which has an electron beam hole and which are arranged along a traveling direction of the electron beam, at least one of the intermediate electrodes has a disk-like shape, the disk-like intermediate electrode is arranged at a position which satisfies (distance between focus electrode and disk-like intermediate electrode)≠(distance between disk-like intermediate electrode and anode electrode), the disk-like intermediate electrode has a non-circular electron beam hole, voltages to be applied to the respective intermediate electrodes are determined at values between a voltage of the focus electrode and a voltage of the anode electrode, the voltage to be applied to an intermediate electrode arranged to oppose the focus electrode is lower than the voltages to be applied to remaining intermediate electrodes, and the voltages to be applied to the intermediate electrodes sequentially increase in the traveling direction of the electron beam, the voltage to be applied to the disk-like intermediate electrode is applied such that a potential distribution on an axis extending through the electron beam hole in a certain deflecting amount is substantially equivalent to that obtained when the disk-like intermediate electrode is not provided, a value of {(voltage of disk-like intermediate electrode)−(voltage of focus electrode)}/{(voltage of anode)−(voltage of focus electrode)} changes in synchronism with an increase in a deflecting amount of the electron beam, and as the deflecting amount of the deflecting beam deflected by the deflecting yoke increases, a focusing power in the vertical direction of the main lens formed of the focus electrode to anode electrode becomes smaller than that in the horizontal direction.

According to the present invention, there is provided, in the color cathode ray tube apparatus described above, a color cathode ray tube apparatus wherein the disk-like intermediate electrode is arranged at a position which satisfies (distance between focus electrode and disk-like intermediate electrode)<(distance between disk-like intermediate electrode and anode electrode), the disk-like intermediate electrode has a non-circular electron beam hole with a major axis in a direction parallel to the vertical direction of the screen, and voltages are applied to the respective electrodes such that a value of {(voltage of disk-like intermediate electrode)−(voltage of focus electrode)}/{(voltage of anode)−(voltage of focus electrode)} decreases in synchronism with an increase in deflecting amount of the electron beam.

According to the present invention, there is provided, in the color cathode ray tube apparatus described apparatus, a color cathode ray tube apparatus wherein the disk-like intermediate electrode is arranged at a position which satisfies (distance between focus electrode and disk-like intermediate electrode)>(distance between disk-like intermediate electrode and anode electrode), the disk-like intermediate electrode has a non-circular electron beam hole with a major axis in a direction parallel to the horizontal direction of the screen, and voltages are applied to the respective electrodes such that a value of {(voltage of disk-like intermediate electrode)−(voltage of focus electrode)}/{(voltage of anode)−(voltage of focus electrode)} increases in synchronism with an increase in deflecting amount of the electron beam.

The problems described with reference to the prior art can be solved by forming a tetrode lens, which dynamically changes and has a sufficiently high sensitivity, in a main lens. A method of forming a tetrode lens, and the operation of the tetrode lens will be described below.

FIG. 8A shows a sectional view of electrodes that form a general rotationally symmetric bi-potential main lens, and equipotential lines of electric fields formed by the electrodes. The electric fields shown in FIG. 8A are formed symmetrical in the horizontal and vertical directions. An electron beam 9 in the horizontal direction and an electron beam 10 in the electrical direction are focused with almost the same focusing powers. The potential of the electrode central axis increases along the traveling direction of the electron beam, as shown in FIG. 8B. In this case, assume that a voltage of 6 kV and a voltage of 26 kV are applied to a focus electrode 11 and an anode electrode 12, respectively. The equipotential surface formed at the mechanical center of the main lens forms a flat surface and has a potential of 16 kV.

As shown in FIG. 9A, a disk electrode 13 is arranged at the mechanical center of a rotationally symmetric bi-potential lens, in the same manner as in FIG. 8A. The disk electrode 13 has electron beam holes with a diameter larger in the vertical direction than in the horizontal direction. When a potential of 16 kV is applied to the disk electrode 13, a potential distribution is formed by the electrodes as shown in FIG. 9A. In the electrode structure shown in FIG. 9A, its on-axis potential changes as shown in FIG. 9B. An electron lens substantially equivalent to an electrode structure with no disk electrode 13 is formed. In other words, the electron beam 9 in the horizontal direction and the electron beam 10 in the vertical direction are focused with almost the same focusing powers.

FIG. 10A shows equipotential lines of a horizontal plane and vertical plane obtained when the voltage of the focus electrode is changed to a value higher than 6 kV, and the loci of electron beams that become incident in the same manner as in FIGS. 8A and 9A. FIG. 10B shows a change in on-axis potential which occurs when the voltage of the focus electrode is increased. When the voltage to be applied to the focus electrode is increased, a difference is produced between a potential gradient TF directed from the disk-like intermediate electrode 13 toward the focus electrode and a potential gradient TA directed from the disk-like intermediate electrode 13 toward the anode electrode. Note that TF<TA. Hence, potential penetration occurs from the anode electrode to the focus electrode through the electron beam holes of the disk electrode 13 to form an aperture lens. The electron beam holes of the disk electrode 13 are vertically elongated holes. Thus, the focusing power of the electron beam produces a strong focusing effect in the horizontal direction and a weak focusing effect in the vertical direction. In other words, astigmatism can be provided to the main lens. With the above arrangement, however, an astigmatism effect sufficiently strong for compensating for a decrease in lens operation of the main lens, which occurs when the voltage of the focus electrode is increased, cannot be obtained in the horizontal direction of the electron beam. This is because potential penetration caused by increasing the voltage of the focus electrode is comparatively small, and a sufficient lens effect cannot be obtained.

The operation of the present invention will be described. An intermediate electrode 13-2 is arranged at the mechanical center between a focus electrode 11 and anode electrode 12 of a rotationally symmetric bi-potential lens. A disk-like intermediate electrode 13-1 is arranged at the mechanical center between the focus electrode 11 and intermediate electrode 13-2. The disk-like intermediate electrode 13-1 has electron beam holes with a diameter larger in the vertical direction than in the horizontal direction. The intermediate electrode 13-2 has circular electron beam holes. FIG. 11A shows a field distribution obtained when potentials of 11 kV and 16 kV are applied to the disk-like intermediate electrode 13-1 and intermediate electrode 13-2, respectively. As shown in FIG. 11A, the on-axis potential changes as shown in FIG. 11B, and an electron lens similar to that obtained with no disk-like intermediate electrode 13-1 is formed. In other words, an electron beam 9 in the horizontal direction and an electron beam 10 in the vertical direction undergo almost the same focusing operations.

FIG. 12A shows equipotential lines of a horizontal plane and vertical plane obtained when the voltage of the focus electrode is changed to a value higher than 6 kV, and the loci of electron beams that become incident in the same manner as in FIGS. 9A and 10A. FIG. 12B shows a change in on-axis potential which occurs when the voltage of the focus electrode is increased. When the voltage of the focus electrode is increased, potential penetration occurs from the anode electrode to the focus electrode through electron beam holes in a disk electrode 13. Thus, an aperture lens is formed. The electron beam holes in the disk electrode are vertically elongated holes. Thus, the focusing power of the electron beam produces a strong focusing effect in the horizontal direction and a weak focusing effect in the vertical direction. In other words, astigmatism is formed in the main lens. In addition, in this case, when compared to a case described above wherein the disk-like intermediate electrode is arranged at the mechanical center of the bi-potential lens, the difference between the potential gradient from the disk-like intermediate electrode to the focus electrode and that from the disk-like intermediate electrode to the anode electrode can be made larger than that obtained when the disk-like intermediate electrode is arranged at the mechanical center of the bi-potential lens. Therefore, potential penetration can be increased, and a sufficient lens effect can be obtained.

An intermediate electrode 13-1 is arranged at the mechanical center between a focus electrode 11 and anode electrode 12 of a rotationally symmetric bi-potential lens. A disk-like intermediate electrode 13-2 is arranged at the mechanical center between the intermediate electrode 13-1 and anode electrode 12. The intermediate electrode 13-1 has circular electron beam holes. The disk-like intermediate electrode 13-2 has electron beam holes with diameters larger in the horizontal direction than in the vertical direction. FIG. 13A shows a case wherein potentials of 16 kV and 21 kV are applied to the intermediate electrode and disk-like intermediate electrode, respectively. In this case, the on-axis potential changes as shown in FIG. 13B. Thus an electron lens similar to that with no disk electrode can be formed. In other words, an electron beam 9 in the horizontal direction and an electron beam 10 in the vertical direction undergo almost the same focusing operations.

FIG. 14A shows equipotential lines of a horizontal plane and vertical plane obtained when the voltages of the focus electrode and disk-like intermediate electrode are changed to values higher than 6 kV and 21 kV, respectively, and the loci of electron beams that become incident in the same manner as in FIGS. 9A and 10A. FIG. 14B shows an on-axis potential obtained in this case. When the voltages of the focus electrode and disk-like intermediate electrode are increased, potential penetration occurs from the focus potential to the anode electrode through electron beam holes in the disk electrode. Thus, an aperture lens is formed. The electron beam hole s in the disk electrode are horizontally elongated holes. Thus, the focusing power of the electron be am produces a weak divergent effect in the horizontal direction and a strong divergent effect in the vertical direction. In other words, astigmatism is formed in the main lens. In addition, a sufficient lens effect can be obtained also in this case.

The above description refers to a case wherein only the voltage of the focus electrode is to be changed and a case wherein the voltages of the focus electrode and disk-like intermediate electrode are to be changed. It suffices as far as the value of {(voltage of disk-like intermediate electrode)−(voltage of focus electrode)}/{(voltage of anode electrode)−(voltage of focus electrode)} can be changed. Accordingly, the electrode, the voltage of which is to be changed, can be any one. Voltages to a plurality of electrodes may be changed simultaneously.

BRIEF DESCRIPTION OF THE SEVERAL VIEWS OF THE DRAWING

FIGS. 9A and 9B are a view showing the potential distribution on the horizontal and vertical sections obtained when a disk electrode is inserted in a rotationally symmetric bi-potential lens, and a graph showing equipotential lines, respectively;

FIGS. 10A and 10B are a view showing the potential distribution on the horizontal and vertical sections obtained when a disk electrode is inserted in a rotationally symmetric bi-potential lens, and a graph showing equipotential lines, respectively;

FIGS. 11A and 11B are a view showing the potential distribution on the horizontal and vertical sections obtained when two intermediate electrodes are inserted in a rotationally symmetric bi-potential lens, and a graph showing equipotential lines, respectively, in an electron gun according to an embodiment of the present invention;

FIGS. 12A and 12B are a view showing the potential distribution on the horizontal and vertical sections obtained when two intermediate electrodes are inserted in a rotationally symmetric bi-potential lens, and a graph showing equipotential lines, respectively, in an electron gun according to another embodiment of the present invention;

DETAILED DESCRIPTION OF THE INVENTION

A color cathode ray tube according to the present invention will be described with reference to the accompanying drawings by way of embodiments.

Figure 1:
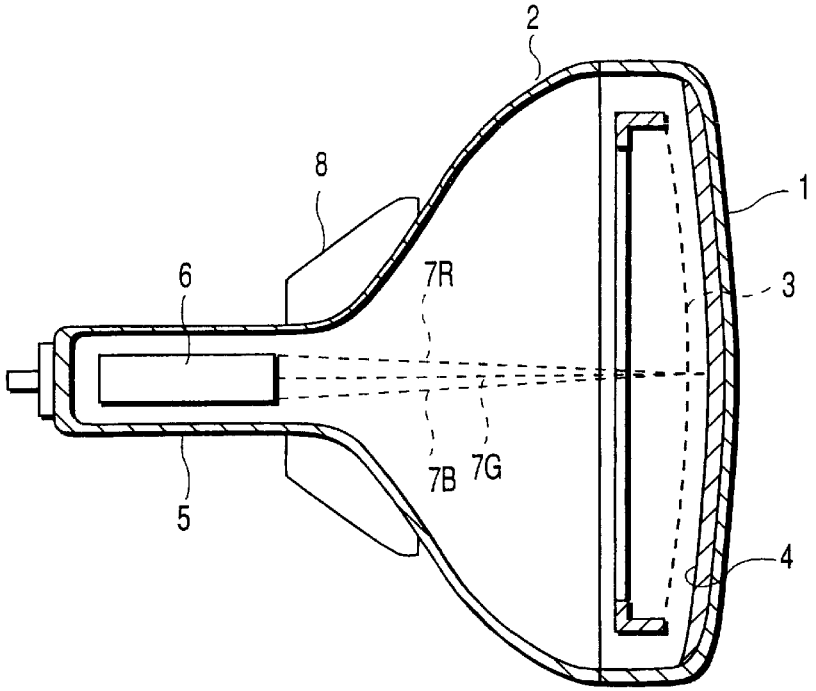
PRIOR ART FIG. 1
FIG. 1 is a sectional view schematically showing the structure of a general color cathode ray tube.
Figure 2:
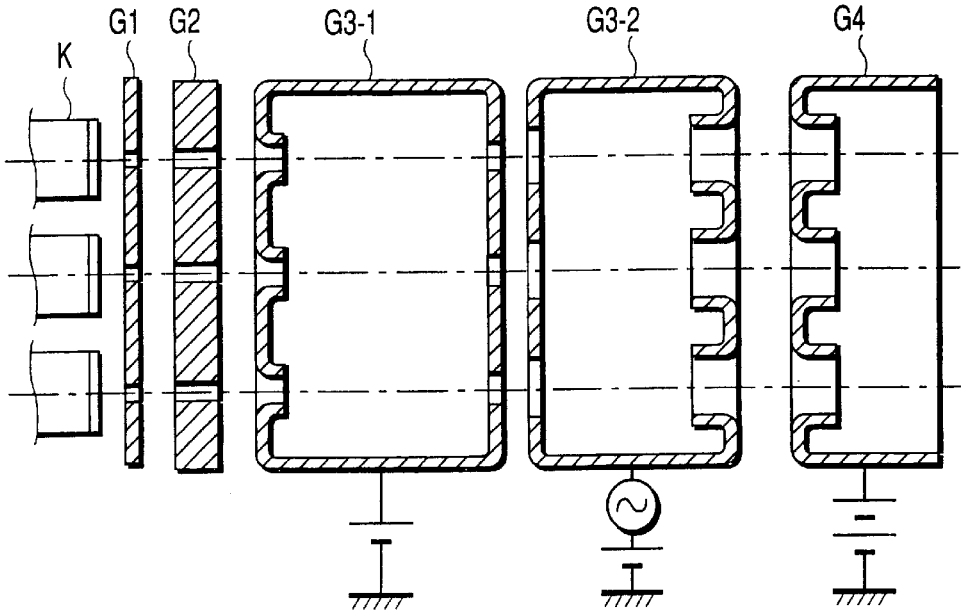
PRIOR ART FIG. 2
FIG. 2 is a sectional view schematically showing the structure of an electron gun to be built into the color cathode ray tube shown in FIG. 1 along a horizontal section.
Figure 3A:
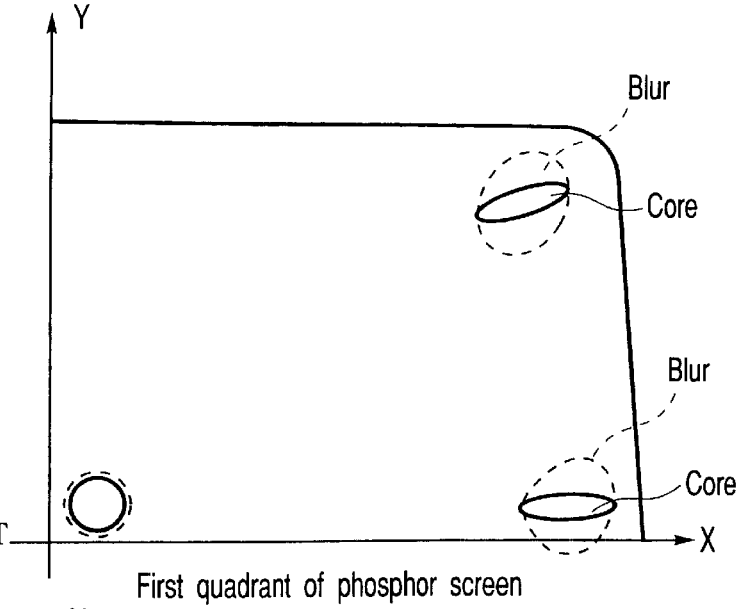
PRIOR ART FIG. 3A
FIGS. 3A and 3B are plan views for explaining the elliptic distortion of electron beam spots formed on a phosphor screen by the electron gun shown in FIG. 2.
Figure 3B:
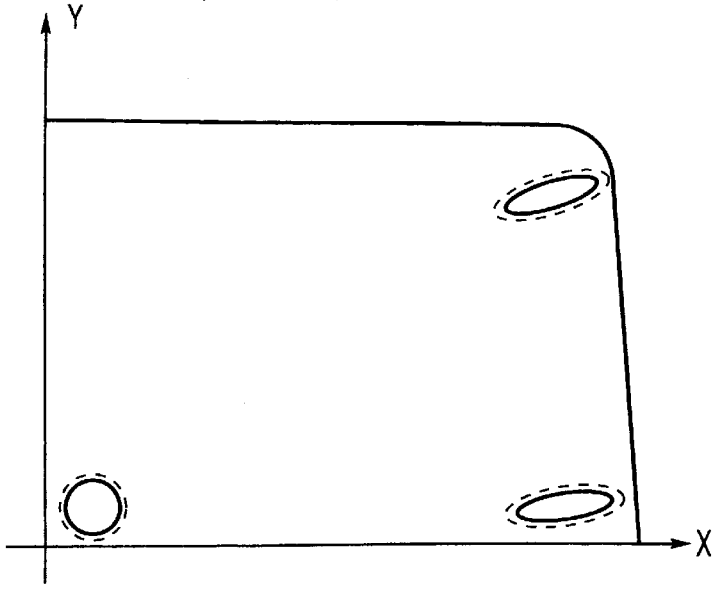
PRIOR ART FIG. 3B
Figure 4A:
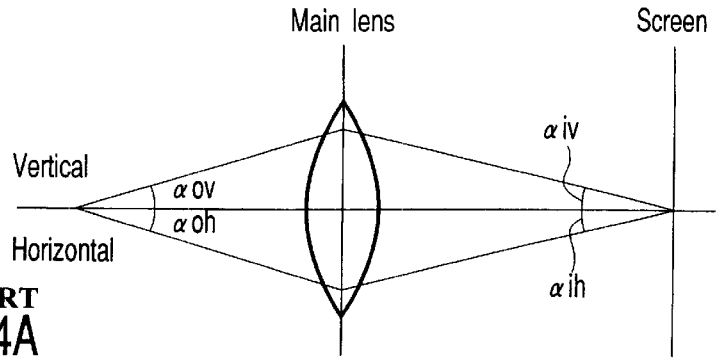
PRIOR ART FIG. 4A
FIGS. 4A, 4B, and 4C are explanatory views showing the electron optical systems of the electron gun shown in FIG. 2 by means of optical lens models.
Figure 4B:
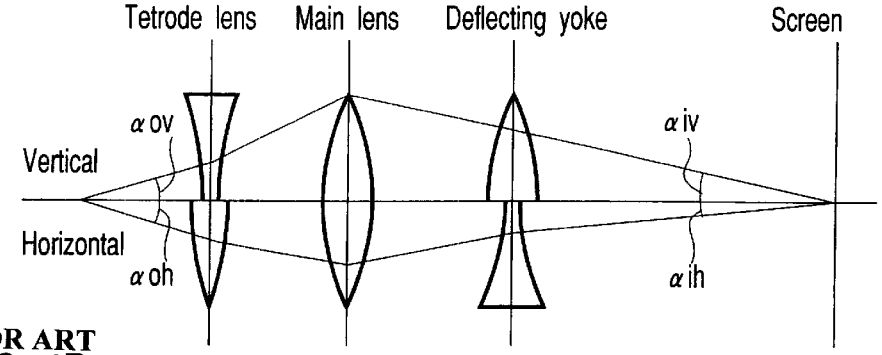
PRIOR ART FIG. 4B
Figure 4C:
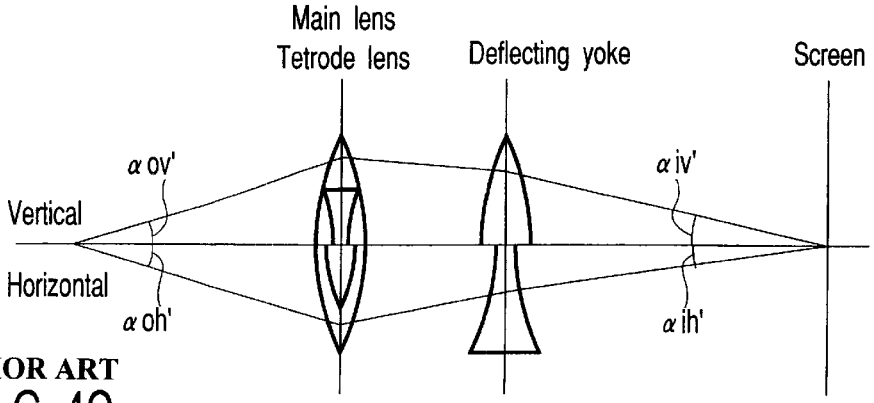
PRIOR ART FIG. 4C
Figure 5:
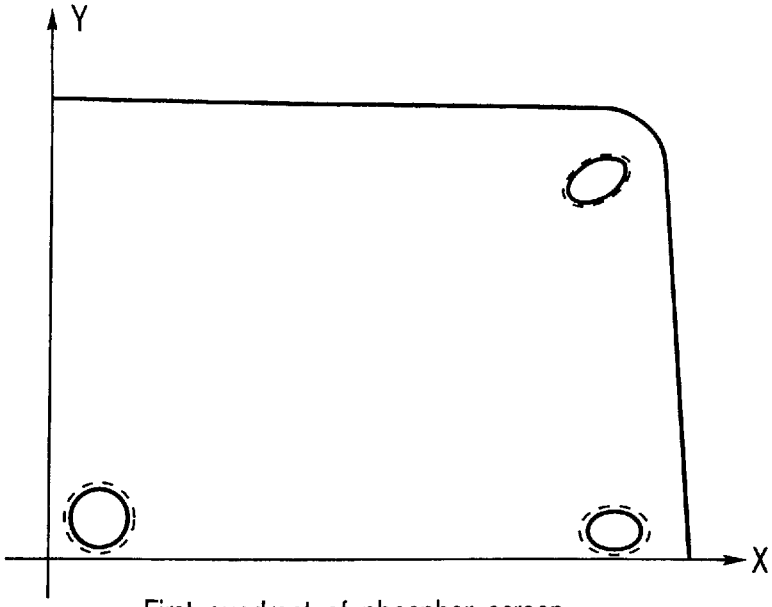
PRIOR ART FIG. 5
FIG. 5 is a plan view f or explaining that the elliptic distortion of the electron beam spots formed on the phosphor screen by the electron gun with the optical system shown in FIG. 4C is improved.

The color cathode ray tube according to the present invention has almost the same structure as that of the general cathode ray tube shown in FIG. 1, and a description thereof will accordingly be omitted. Regarding the structure of the cathode ray tube, refer to FIG. 1 and its description.

Figure 15:
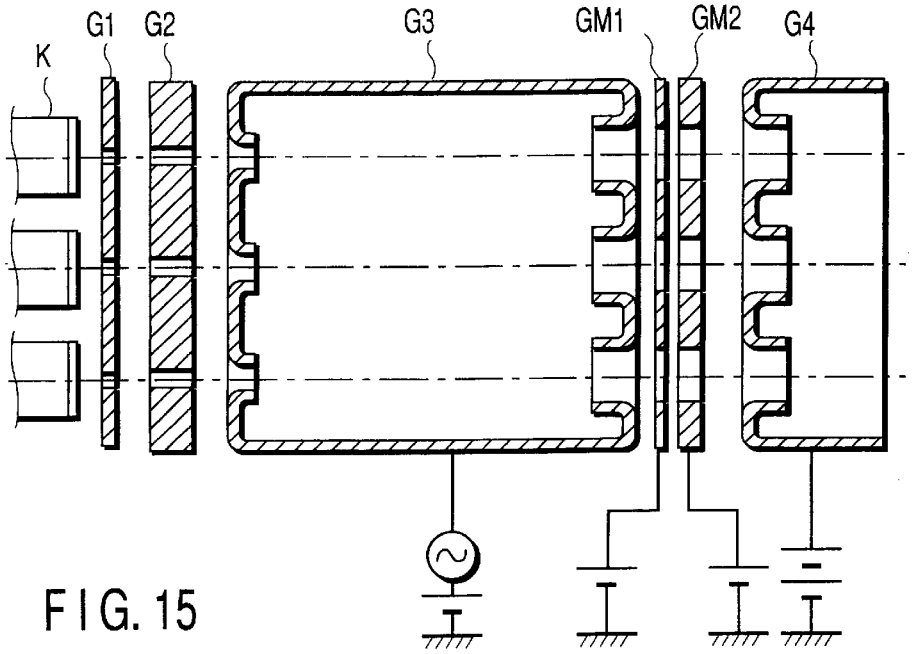
FIG. 15 is a sectional view schematically showing the structure of an electron gun to be built into a color cathode ray tube according to an embodiment of the present invention along a horizontal section.

FIG. 15 shows an electron gun to be built in a color cathode ray tube according to an embodiment of the present invention. The electron gun shown in FIG. 15 is an in-line type electron gun that emits three in-line electron beams made up of a center beam and a pair of side beams traveling on one horizontal plane. This electron gun has three cathodes K, three heaters (not shown) for heating the cathodes K separately, and first to fourth grids G1 to G4. The grids G1 to G4 are integrated with each other and sequentially arranged on the cathodes K to be adjacent to each other. These components are integrally fixed with a pair of insulating supports (not shown).

Figure 6:
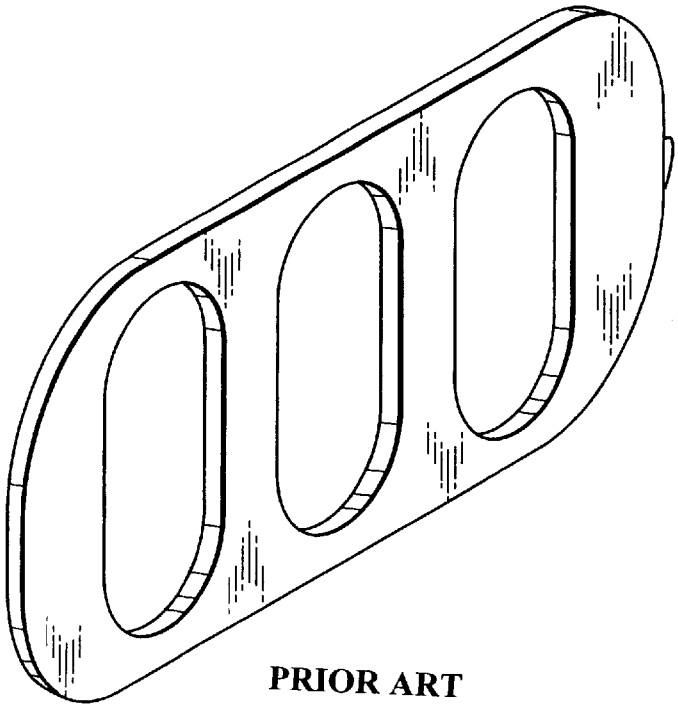
PRIOR ART FIG. 6
FIG. 6 is a perspective view showing a disk-like intermediate electrode to be built into the electrode structure of a conventional electron gun.
Figure 7:
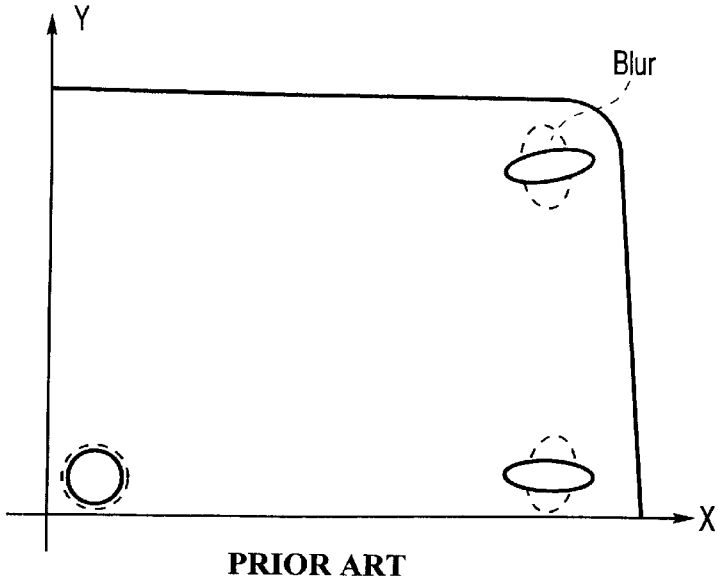
PRIOR ART FIG. 7
FIG. 7 is a plan view for explaining the elliptic distortion of electron beam spots formed on the phosphor screen by an electron gun with the built-in conventional disk-like intermediate electrode shown in FIG. 6.
Figure 8A:
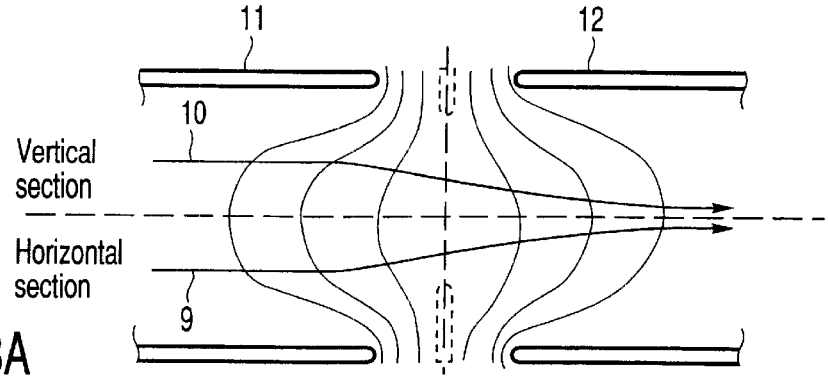
FIGS. 8A and 8B are a view showing the potential distribution on the horizontal and vertical sections of a rotationally symmetric bi-potential lens, and a graph showing equipotential lines, respectively.
Figure 8B:
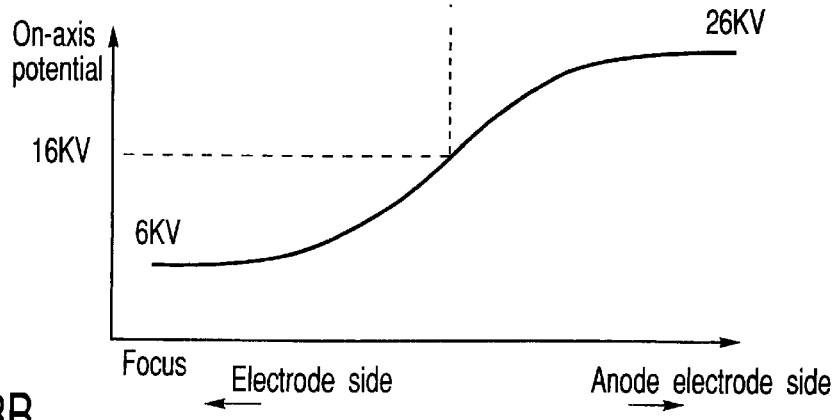
Figure 13A:
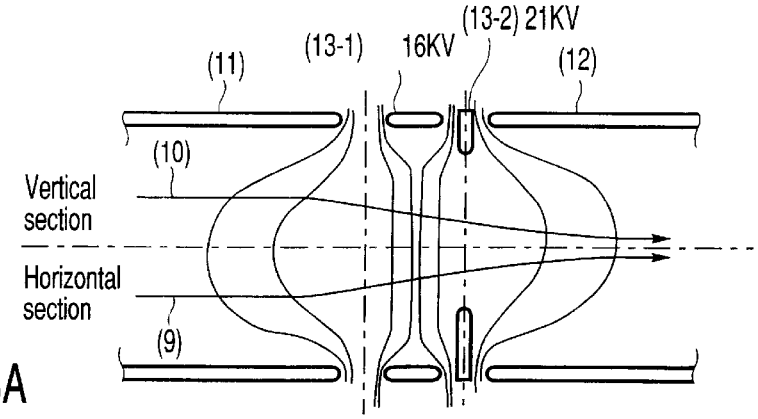
FIGS. 13A and 13B are a view showing the potential distribution on the horizontal and vertical sections obtained when two intermediate electrodes are inserted in a rotationally symmetric bi-potential lens, and a graph showing equipotential lines, respectively, in an electron gun according to still another embodiment of the present invention.
Figure 13B:
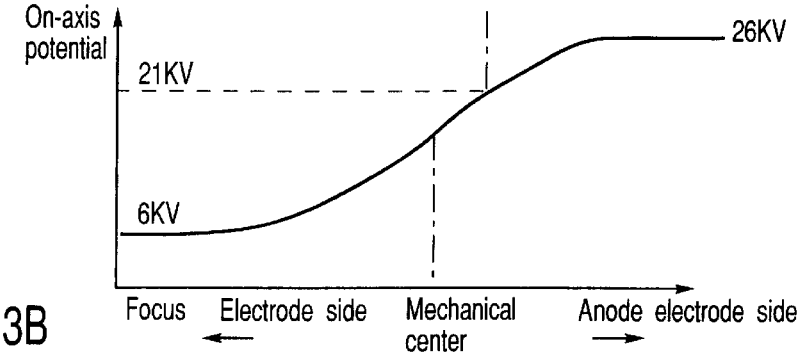
Figure 14A:
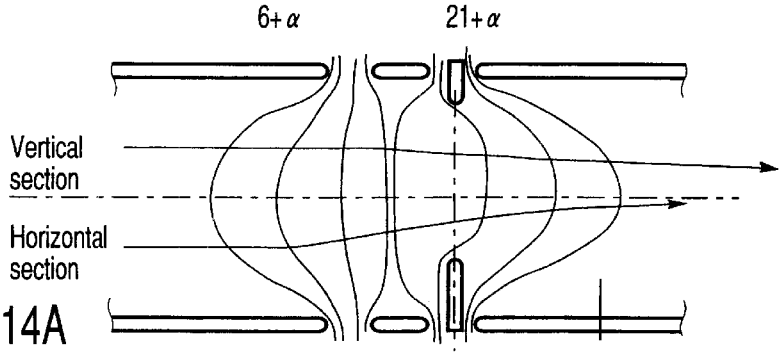
FIGS. 14A and 14B are a view showing the potential distribution on the horizontal and vertical sections obtained when two intermediate electrodes are inserted in a rotationally symmetric bi-potential lens, and a graph showing equipotential lines, respectively, in an electron gun according to still another embodiment of the present invention.
Figure 14B:
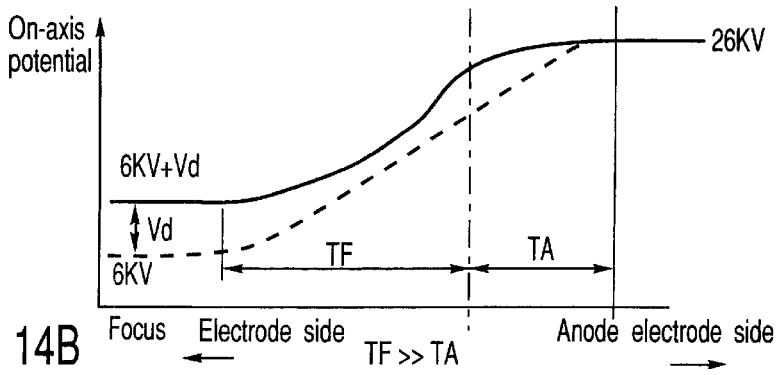

Of the grids described above, each of the first and second grids G1 and G2 has a plate-like shape, and three electron beam holes in its plate surface to correspond to the three in-line cathodes K. The third grid G3 is a cylindrical electrode, and has electron beam holes in each of its two ends. The fourth grid G4 also has electron beam holes on the third grid G3 side. An intermediate electrode GM2 having circular holes is arranged at the mechanical center between the third and fourth grids G3 and G4. A disk-like intermediate electrode GM1 having longitudinally elongated holes as shown in FIG. 6 is arranged at the mechanical center between the third grid G3 and intermediate electrode GM2.

Figure 16A:
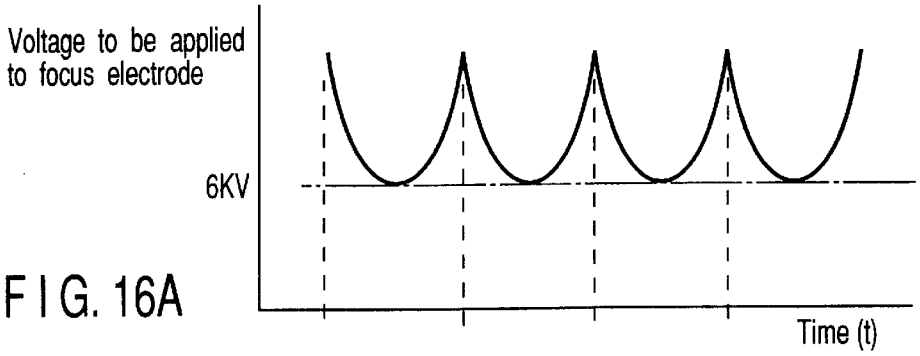
FIGS. 16A and 16B are waveform charts showing a voltage to be applied to the focus electrode and that to be applied to the deflecting yoke, respectively, of the electron gun shown in FIG. 15.
Figure 16B:
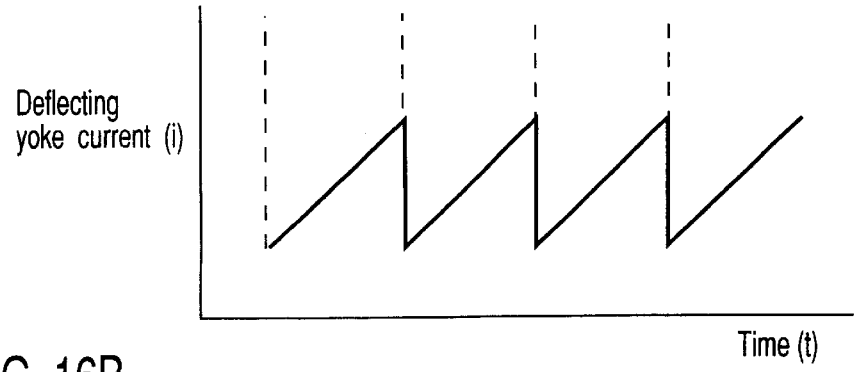

A voltage of about 6 kV is applied to the third grid G3. Also, a parabolic voltage as shown in FIG. 16A, which increases as the deflecting amount increases in synchronism with the deflecting yoke, is applied to the third grid G3. A voltage of about 11 kV is applied to the disk-like intermediate electrode GM1. A voltage of about 16 kV is applied to the other intermediate electrode GM2. A voltage of about 26 kV is applied to the fourth grid G4.

When the electron beam is not deflected by the deflecting yoke, the electron lens formed of the third to fourth grids G3 to G4 does not have astigmatism. The electron beams emitted from the cathodes K pass through the first and second grids G1 and G2. The electron beams are then focused to the center of the phosphor lens by the main lens formed of the third to fourth grids G3 to G4. Thus, almost circular electron beam spots are formed.

A case wherein the electron beams are deflected by the deflecting yoke will be described. As the electron beams are deflected by the deflecting yoke to the periphery of the phosphor screen, the voltage of the third grid G3 is increased by the parabolic voltage. In this case, the value of {(voltage of disk-like intermediate electrode)−(voltage of G3)}/{(voltage of G4)−(voltage of G3)} decreases. Since the disk-like intermediate electrode has vertically elongated holes, the focusing power in the horizontal direction becomes larger than that in the vertical direction. Since the voltage difference between the third and fourth grids G3 and G4 decreases, the operation of simultaneously decreasing the focusing power in the horizontal direction and that in the vertical direction occurs. The horizontal focusing power which increases by the effect of the disk-like intermediate electrode and that which decreases by a decrease in voltage difference between the third and fourth grids G3 and G4 cancel each other. With these effects, the electron beam focusing conditions are established also on the periphery of the phosphor screen. Also, the main lens has an astigmatism effect. Hence, the elliptic ratio of the electron beam spot shape is improved.

Assume that the main lens formed of the third and fourth grids G3 and G4 serves as an electron lens with a focusing power larger in the horizontal direction than in the vertical direction. In this case, the same effect as that described above can be obtained by setting low a voltage to be applied to the disk voltage when the electron beams are not deflected. In deflection, a voltage that changes in a parabolic manner is applied to the third grid G3, and {(voltage of disk-like intermediate electrode)−(voltage of G3)}/{(voltage of G4)−(voltage of G3)} is set low. The horizontal focusing power which increases by the effect of the disk electrode and that which decreases by a decrease in voltage difference between the third and fourth grids G3 and G4 cancel each other. Therefore, the same effect as that in the above embodiment can be obtained.

Figure 17:
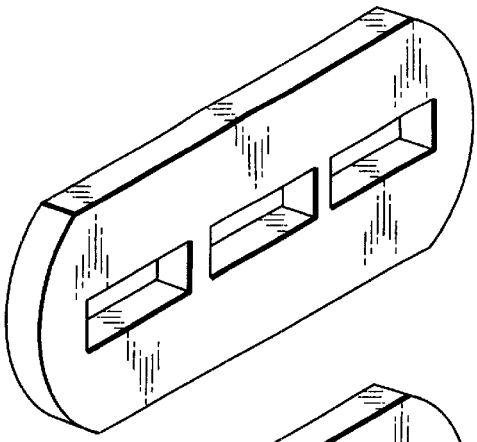
FIG. 17 is a perspective view showing an example of the disk-like electrode to be built into the electrode structure of the electron gun shown in FIG. 15.
Figure 18:
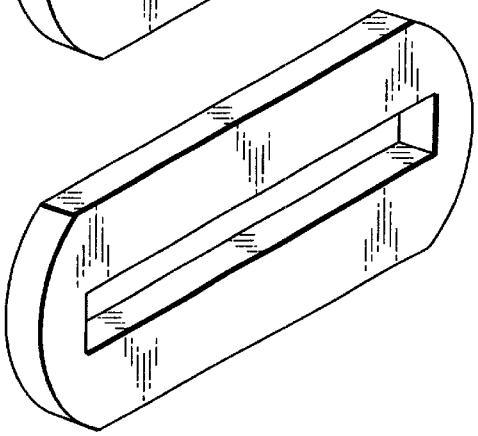
FIG. 18 is a perspective view showing another example of the disk-like electrode to be built into the electrode structure of the electron gun shown in FIG. 15.
Figure 19A:
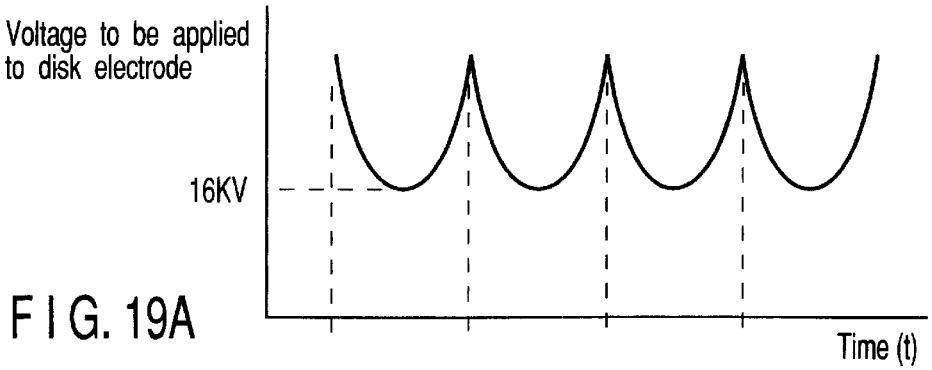
FIGS. 19A and 19B are waveform charts showing a voltage to be applied to the disk-like intermediate electrode and that to be applied to the deflecting yoke, respectively, of the electron gun shown in FIG. 15.
Figure 19B:
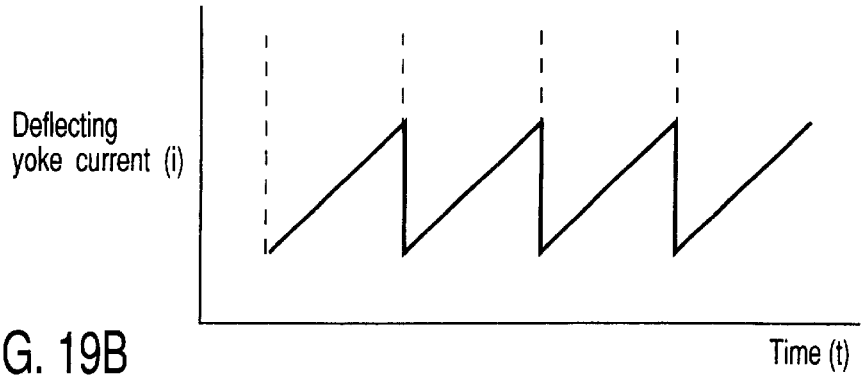
Figure 20:
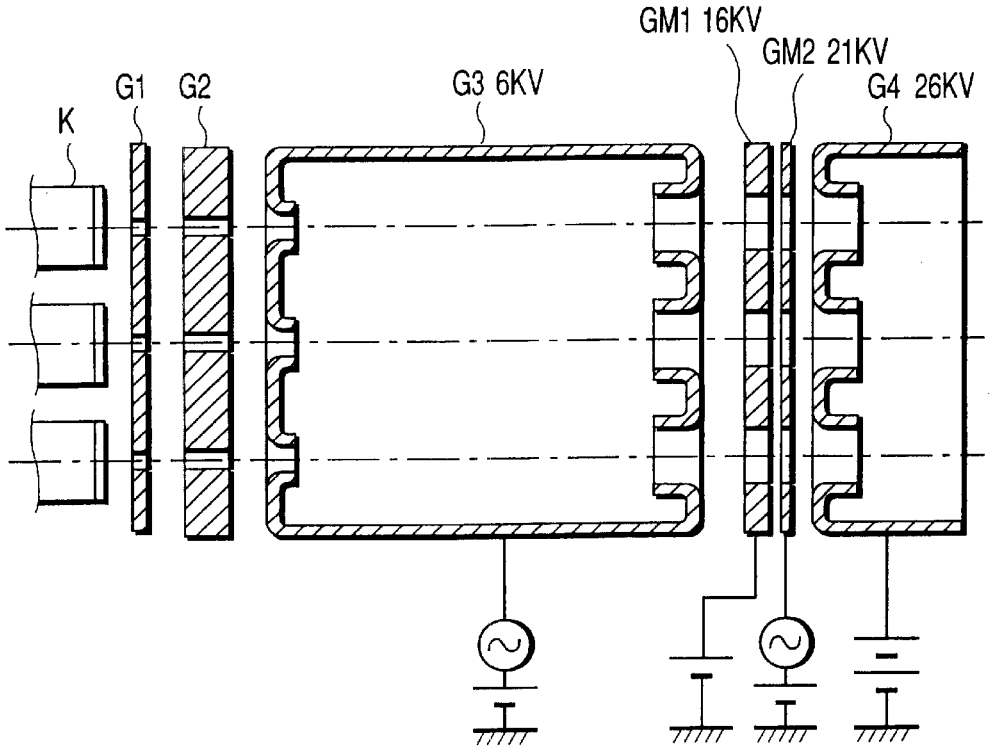
FIG. 20 is a sectional view schematically showing the structure of an electron gun to be built into a color cathode ray tube according to another embodiment of the present invention along a horizontal section.

An embodiment of a case will be described wherein the electron beam holes of the disk electrode are horizontally elongated holes as shown in FIG. 17 or 18, while the basic structure is the same as that of the above embodiment. The basic structure of an electron gun is shown in FIG. 20. Since the electron beam holes of the disk electrode are laterally elongated holes, a voltage of about 6 kV is applied to the third grid G3. Also, a parabolic voltage as shown in FIG. 16A, which increases as the deflecting amount increases in synchronism with the deflecting yoke, is applied to the third grid G3. A voltage of about 16 kV is applied to the intermediate electrode GM1. Also, a voltage of about 21 kV is applied to the disk-like intermediate electrode GM2. A parabolic voltage as shown in FIG. 16A, which increases as the deflecting amount increases in synchronism with the deflecting yoke, is applied to the disk-like intermediate electrode GM2. A voltage of about 26 kV is applied to the fourth grid G4.

Assume a case wherein the electron beams are not deflected by the deflecting yoke. In this case, the electron lens formed of the third to fourth grids G3 to G4 does not have astigmatism. The electron beams emitted from the cathodes K pass through the first and second grids G1 and G2. The electron beams are then focused to the center of the phosphor lens by the main lens formed of the third to fourth grids G3 to G4. Thus, almost circular electron beam spots are formed.

A case wherein the electron beams are deflected by the deflecting yoke will be described. As the electron beams are deflected by the deflecting yoke to the periphery of the phosphor screen, the voltage of the third grid G3 is increased by the parabolic voltage. Also, a parabolic voltage with almost the same amplitude as that of the parabolic voltage applied to the third grid G3 is applied to the disk-like intermediate electrode.

Hence, the value of {(voltage of disk-like intermediate electrode)−(voltage of G3)}/{(voltage of G4)−(voltage of G3)} increases. Since the disk-like intermediate electrode has laterally elongated holes, the focusing power in the horizontal direction becomes larger than that in the vertical direction. Since the voltage difference between the third and fourth grids G3 and G4 decreases, the operation of simultaneously decreasing the focusing power in the horizontal direction and that in the vertical direction occurs. The horizontal focusing power which increases by the effect of the disk-like intermediate electrode and that which decreases by a decrease in voltage difference between the third and fourth grids G3 and G4 cancel each other. With these effects, the electron beam focusing conditions are established also on the periphery of the phosphor screen. Also, the main lens has an astigmatism effect. Hence, the elliptic ratio of the electron beam spot shape is improved.

Assume that the main lens formed of the third and fourth grids G3 and G4 serves as an electron lens with a focusing power larger in the horizontal direction than in the vertical direction. In this case, the same effect as that described above can be obtained by setting high a voltage to be applied to the disk-like intermediate electrode when the electron beams are not deflected. In deflection, a voltage that changes in a parabolic manner is applied to the third grid G3, and {(voltage of disk-like intermediate electrode)−(voltage of G3)}/{(voltage of G4)−(voltage of G3)} is set high. The horizontal focusing power which increases by the effect of the disk electrode and that which decreases by a decrease in voltage difference between the third and fourth grids G3 and G4 cancel each other. Therefore, the same effect as that in the above embodiment can be obtained.

As has been described above, according to the present invention, when a main lens for focusing electron beams finally on the phosphor screen is imparted with an astigmatism effect that dynamically changes, the elliptic distortion of the electron beam spot can be moderated on the entire surface of the phosphor screen. That is, a color cathode ray tube apparatus with a good image quality can be provided.

What is claimed is:

1. A color cathode ray tube apparatus comprising:

a screen;

an electron gun which generates an electron beam and in which a main lens for accelerating and focusing the electron beam toward said screen is formed; and a deflecting yoke which scans the electron beam emitted from said electron gun in horizontal and vertical directions, wherein the main lens is formed of a focus electrode, a plurality of intermediate electrodes, and an anode electrode each of which has an electron beam hole and which are arranged along a traveling direction of the electron beam, at least one of the intermediate electrodes has a disk-like shape, the disk-like intermediate electrode is arranged at a position which satisfies (distance between focus electrode and disk-like intermediate electrode)≠(distance between disk-like intermediate electrode and anode electrode), the disk-like intermediate electrode has a non-circular electron beam hole, voltages to be applied to the respective intermediate electrodes are determined at values between a voltage of the focus electrode and a voltage of the anode electrode, the voltage to be applied to an intermediate electrode arranged to oppose the focus electrode is lower than the voltages to be applied to remaining intermediate electrodes, and the voltages to be applied to the intermediate electrodes sequentially increase in the traveling direction of the electron beam, the voltage to be applied to the disk-like intermediate electrode is applied such that a potential distribution on an axis extending through the electron beam hole in a certain deflecting amount is substantially equivalent to that obtained when the disk-like intermediate electrode is not provided, a value of {(voltage of disk-like intermediate electrode)−(voltage of focus electrode)}/{(voltage of anode)−(voltage of focus electrode)} changes in synchronism with an increase in a deflecting amount of the electron beam, and as the deflecting amount of the deflecting beam deflected by said deflecting yoke increases, a focusing power in the vertical direction of the main lens formed of the focus electrode to anode electrode becomes smaller than that in the horizontal direction.

2. A color cathode ray tube apparatus according to claim 1, wherein the disk-like intermediate electrode is arranged at a position which satisfies (distance between focus electrode and disk-like intermediate electrode)<(distance between disk-like intermediate electrode and anode electrode), the disk-like intermediate electrode has a non-circular electron beam hole with a major axis in a direction parallel to the vertical direction of said screen, and voltages are applied to the respective electrodes such that a value of {(voltage of disk-like intermediate electrode)−(voltage of focus electrode)}/{(voltage of anode)−(voltage of focus electrode)} decreases in synchronism with an increase in deflecting amount of the electron beam.

3. A color cathode ray tube apparatus according to claim 1, wherein the disk-like intermediate electrode is arranged at a position which satisfies (distance between focus electrode and disk-like intermediate electrode)>(distance between disk-like intermediate electrode and anode electrode), the disk-like intermediate electrode has a non-circular electron beam hole with a major axis in a direction parallel to the horizontal direction of said screen, and voltages are applied to the respective electrodes such that a value of {(voltage of disk-like intermediate electrode)−(voltage of focus electrode)}/{(voltage of anode)−(voltage of focus electrode)} increases in synchronism with an increase in deflecting amount of the electron beam.

* * * * *